US009304434B2

(12) United States Patent
Taniguchi

(10) Patent No.: US 9,304,434 B2
(45) Date of Patent: Apr. 5, 2016

(54) DEVELOPING DEVICE AND IMAGE FORMING APPARATUS INCLUDING SAME

(71) Applicant: KYOCERA Document Solutions Inc., Osaka-shi, Osaka (JP)

(72) Inventor: Ryo Taniguchi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/446,230

(22) Filed: Jul. 29, 2014

(65) Prior Publication Data

US 2015/0043947 A1 Feb. 12, 2015

(30) Foreign Application Priority Data

Aug. 12, 2013 (JP) ..... 2013-167290

(51) Int. Cl.
*G03G 15/08* (2006.01)
*G03G 15/09* (2006.01)

(52) U.S. Cl.
CPC ..... *G03G 15/0812* (2013.01); *G03G 15/0921* (2013.01); *G03G 15/0808* (2013.01)

(58) Field of Classification Search
CPC ..... G03G 15/0812; G03G 15/0921
USPC ..... 399/272, 274, 275, 277
See application file for complete search history.

(56) References Cited

U.S. PATENT DOCUMENTS 8,126,378 B2 * 2/2012 Uetake et al. ..... 399/270

FOREIGN PATENT DOCUMENTS

| | | | |
|---|---|---|---|
| JP | 60011857 A | * | 1/1985 |
| JP | 2009069259 A | | 4/2009 |
| JP | 2009258276 A | | 11/2009 |
| JP | 2011013248 A | | 1/2011 |

* cited by examiner

*Primary Examiner* — Erika J Villaluna
(74) *Attorney, Agent, or Firm* — Alleman Hall McCoy Russell & Tuttle LLP

(57) ABSTRACT

A developing device of the present disclosure includes a magnetic roller and a developing roller arranged so as to oppose the magnetic roller. Inside the magnetic roller, a regulation pole and a conveyance pole are provided. The regulation pole is turned toward an opposing surface side of an end portion of a regulation blade provided in a developer container. The regulation pole and the conveyance pole are arranged such that in magnetic fields formed by these magnetic poles, a point where no magnetic pole perpendicular to a surface of the magnetic roller is generated is located in a gap between the surface of the magnetic roller and the regulation blade.

2 Claims, 4 Drawing Sheets

DEVELOPING DEVICE AND IMAGE FORMING APPARATUS INCLUDING SAME

INCORPORATION BY REFERENCE

This application is based upon and claims the benefit of priority from the corresponding Japanese Patent Application No. 2013-167290 filed on Aug. 12, 2013, the entire contents of which are incorporated herein by reference.

BACKGROUND

The present disclosure relates to a developing device configured to develop an electrostatic latent image on an image carrier by causing the image carrier to hold toner, and an image forming apparatus including the developing device.

An image forming apparatus such as a copying machine or a printer which forms an image on a paper sheet by electrophotography is provided with a developing device. The developing device develops with toner an electrostatic latent image formed on an image carrier such as a photosensitive drum. As a developing method, there has been known a so-called two-component developing method in which a two-component developer composed of magnetic carrier and toner is used to develop a toner image on the image carrier. As one example of the two-component developing method, the following method is known: by use of a magnetic roller provided with a magnet inside thereof and a developing roller arranged so as to be separated from an image carrier by a predetermined gap, only the toner, which is nonmagnetic, is transferred onto the developing roller with the magnetic carrier remaining on the magnetic roller, to form a thin toner layer on the developing roller. Then, the toner is caused to fly to be attached to the electrostatic latent image on the image carrier, from the developing roller in an AC electric field.

In such a typical developing device, in order to convey the toner by a constant amount to a position opposed to the developing roller, a regulation blade is provided which regulates a developer layer to be formed on the surface of the magnetic roller. The regulation blade is arranged on the upstream side in the rotation direction of the magnetic roller during development, relative to a position where the developing roller and the magnetic roller oppose each other.

When the toner is transferred from the developing roller to the image carrier, or when the toner is transferred from the magnetic roller to the developing roller, a part of the toner scatters within a housing of the developing device. A part of the scattered toner attaches to surfaces of the regulation blade, in particular, to a surface thereof turned toward the position where the developing roller and the magnetic roller oppose each other. When the toner attached and accumulated on the surfaces of the regulation blade comes off from the regulation blade and moves to the vicinity of the developing roller or the image carrier, the toner layer on the developing roller is disturbed or the amount of toner held on the developing roller varies. Due to influence of the accumulated toner, an excessive amount of toner is supplied to the image carrier. This may cause a risk of lowered quality of an image to be formed, resulting in poor image.

With regard to this, as a typical method for collecting the toner accumulated on the regulation blade, there is known a method in which magnetic poles provided inside the magnetic roller are rotated.

SUMMARY

A developing device according to one aspect of the present disclosure includes a magnetic roller, a developing roller, a blade member, a first magnetic force generation portion, and a second magnetic force generation portion. The magnetic roller is configured to hold, on a surface thereof, a developer including toner and magnetic carrier. The developing roller is arranged so as to oppose the magnetic roller. The blade member is provided so as to oppose the surface of the magnetic roller on an upstream side relative to the developing roller in a rotation direction of the magnetic roller to be rotated during development. The blade member includes an opposing surface having a predetermined width in the rotation direction. The first magnetic force generation portion is provided, inside the magnetic roller, on an upstream side in the rotation direction relative to a reference line, the reference line passing a center of the opposing surface of the blade member and perpendicular to the opposing surface. The first magnetic force generation portion is configured to provide magnetic force of a predetermined first polarity to the developer held on the magnetic roller. The second magnetic force generation portion is provided, inside the magnetic roller, on a downstream side in the rotation direction relative to the reference line. The second magnetic force generation portion is configured to provide magnetic force of a second polarity opposite to the first polarity to the developer held on the magnetic roller. The first magnetic force generation portion and the second magnetic force generation portion are positioned such that, among magnetic fields formed by the first magnetic force generation portion and the second magnetic force generation portion, a tangent direction magnetic field having only a component in a tangent direction at the surface of the magnetic roller is generated in a gap between the surface of the magnetic roller and the opposing surface.

An image forming apparatus according to another aspect of the present disclosure includes the developing device described above.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
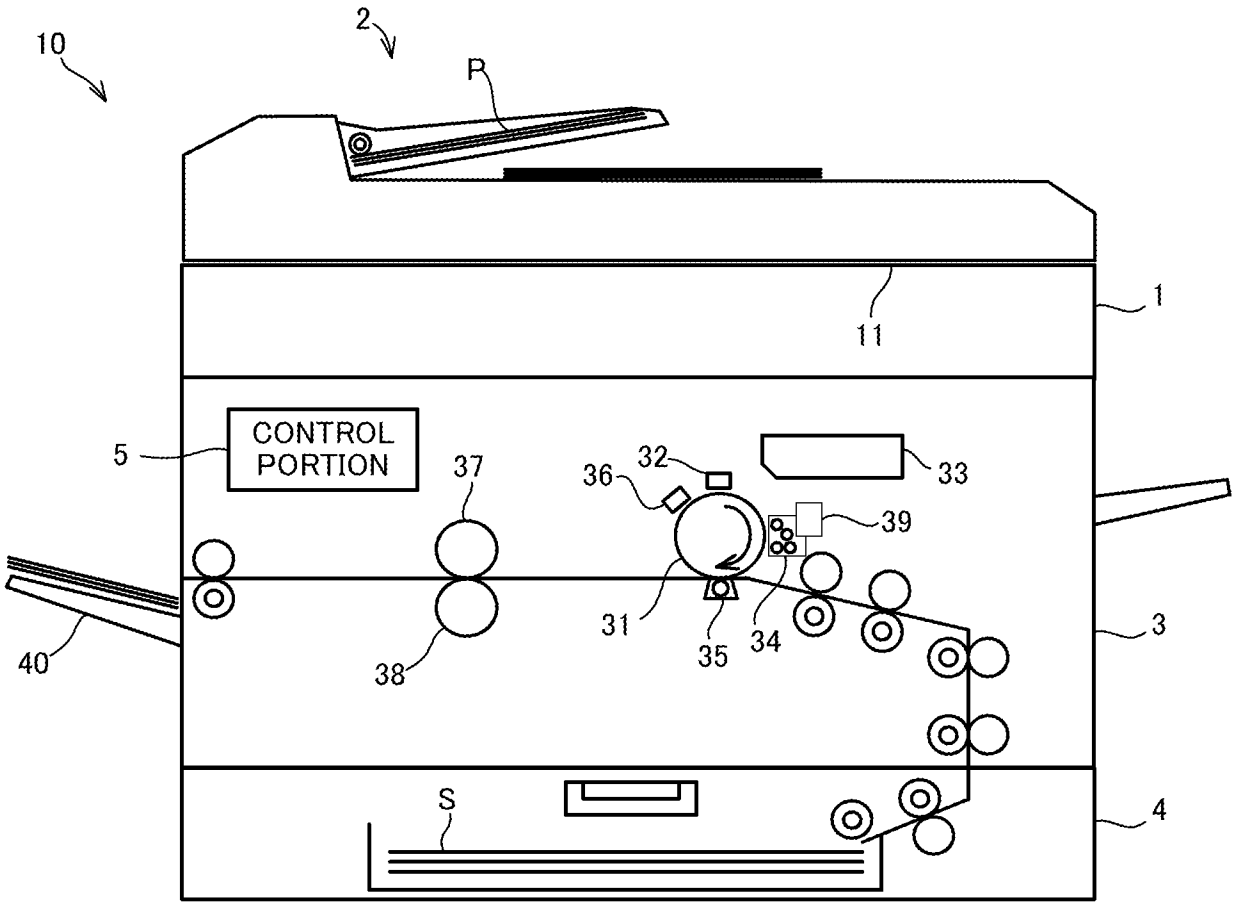
FIG. 1 shows a structure of an image forming apparatus including a developing device according to an embodiment of the present disclosure.

Hereinafter, embodiments of the present disclosure will be described with reference to the accompanying drawings. For convenience of explanation, in a state where an image forming apparatus 10 is disposed in a useable manner (the state shown in FIG. 1), the vertical direction is defined as an up-down direction 7, the face shown in FIG. 1 is defined as the front face of the image forming apparatus 10 to define a front-rear direction 8, and a left-right direction 9 is defined based on the front face of the image forming apparatus 10.

<Structure of Image Forming Apparatus 10>

First, a structure of the image forming apparatus 10 according to an embodiment of the present disclosure will be described. As shown in FIG. 1, the image forming apparatus 10 includes an image reading portion 1, an image forming portion 3, a sheet feed portion 4, a control portion 5, and the like. It should be noted that the image forming apparatus 10 is merely one example of an image forming apparatus of the present disclosure, and the image forming apparatus of the present disclosure may be a printer, a FAX apparatus, a copying machine, or a multifunction peripheral having these functions.

The image reading portion 1 includes an ADF (Automatic Document Feeder) 2. The image reading portion 1 reads an image of a document sheet P set on the ADF 2 or a contact glass 11 to obtain image data. The image reading portion 1 includes, for example, an imaging device such as a CCD (Charge Coupled Device) or a CIS (Contact Image Sensor), an optical lens, a light source, and the like. In the image reading portion 1, light emitted from the light source to the document sheet P and reflected by the document sheet P passes through the optical lens to be received by the imaging device, whereby image data of the document sheet P is read. Description of the details of the image reading portion 1 is omitted.

The sheet feed portion 4 feeds a paper sheet S on which an image is to be formed in the image forming portion 3. The sheet feed portion 4 is provided with a sheet feed cassette not shown, and takes out, one by one, a plurality of the paper sheets S held in the sheet feed cassette, to feed the paper sheet S to the image forming portion 3.

The image forming portion 3 executes an image forming process (printing process) by electrophotography based on image data read in the image reading portion 1 or image data inputted from an external information processing apparatus such as a personal computer. The image forming portion 3 includes a photosensitive drum 31, a charging device 32, an LSU (Laser Scanning Unit) 33, a developing device 34, a transfer roller 35, a charge removing device 36, a fixing roller 37, a pressure roller 38, a toner container 39, and the like.

In the image forming portion 3, an image is formed in the following procedure onto the paper sheet S fed from the sheet feed portion 4. First, the photosensitive drum 31 is uniformly charged to a predetermined potential by the charging device 32. Next, light based on the image data is emitted by the LSU 33 onto the surface of the photosensitive drum 31. Accordingly, an electrostatic latent image is formed on the surface of the photosensitive drum 31. Then, the electrostatic latent image on the photosensitive drum 31 is developed (visualized) as a toner image by the developing device 34 driven by a stepping motor (not shown). Subsequently, the toner image formed on the photosensitive drum 31 is transferred to the paper sheet S by the transfer roller 35. Then, the toner image transferred to the paper sheet S is heated by the fixing roller 37 and melted to be fixed on the paper sheet S when the paper sheet S passes between the fixing roller 37 and the pressure roller 38 to be discharged. The potential of the photosensitive drum 31 is removed by the charge removing device 36. The paper sheet S on which an image has been formed in this manner is then discharged into a sheet discharge tray 40. When the amount of the toner in the developing device 34 is reduced as a result of development, toner is supplied from the toner container 39.

The control portion 5 performs comprehensive control of the image forming apparatus 10, and includes, for example, a CPU, a ROM, a RAM, an EEPROM, a motor driver, and the like. The motor driver of the control portion 5 controls drive of stepping motors (not shown), thereby driving rotating members, such as agitating screws 61A and 61B, a magnetic roller 62, and a developing roller 63 described later, provided in the developing device 34, to rotate. Each stepping motor is rotatable in both directions, and the control portion 5 rotates the stepping motor in either direction as necessary, to rotate the rotating member in a rotation direction (the direction indicated by the arrow 91, 92, 93, 94) that is necessary during development, or in a rotation direction (rotation direction reverse to the rotation direction during development) that is necessary during toner collection described later. It should be noted that the control portion 5 which drives the magnetic roller 62 to rotate in a direction reverse to the direction of the arrow 92 is one example of a rotation control portion of the present disclosure.

<Structure of Developing Device 34>

Figure 2:
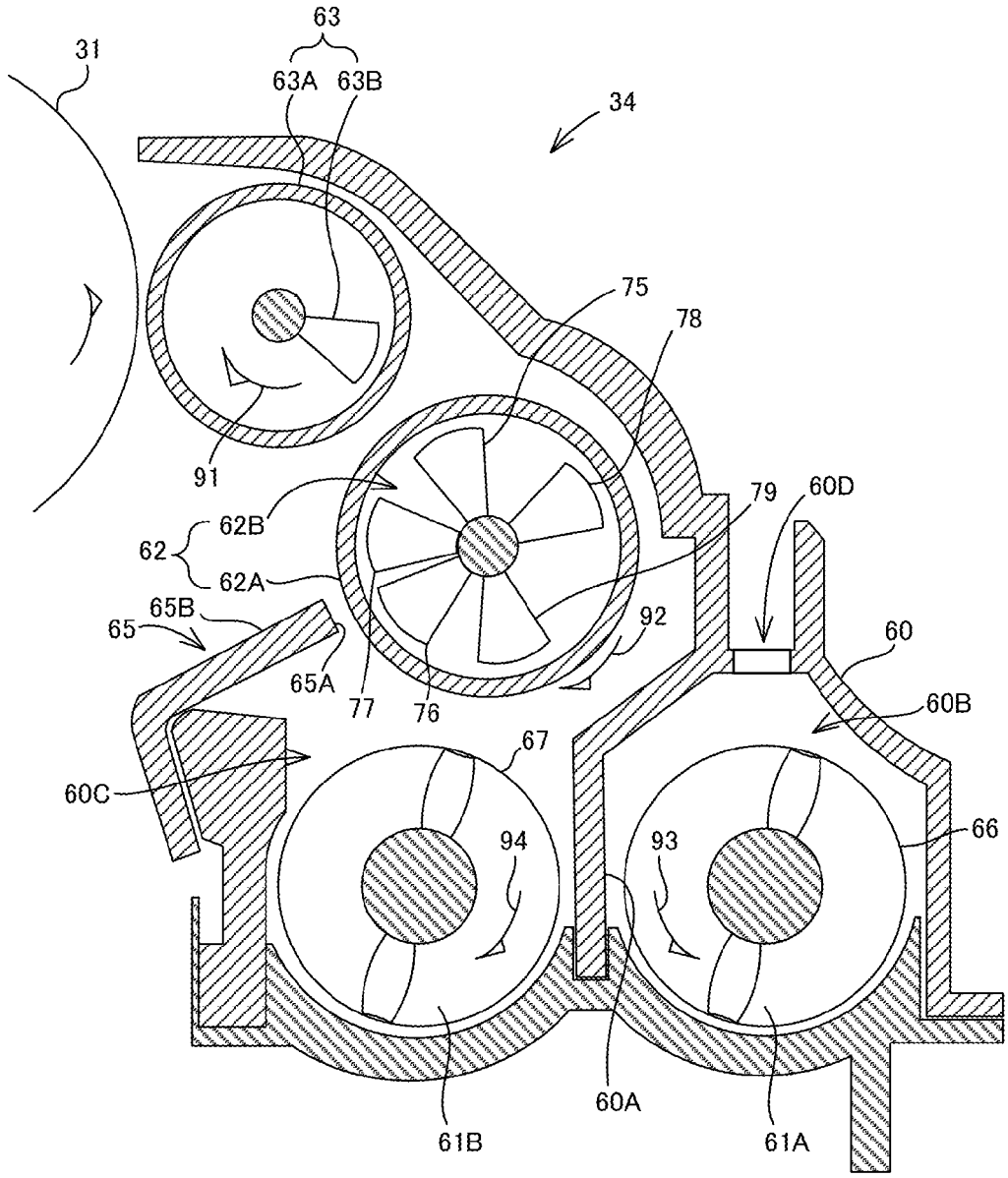
FIG. 2 shows a cross section of the developing device.
Figure 3A:
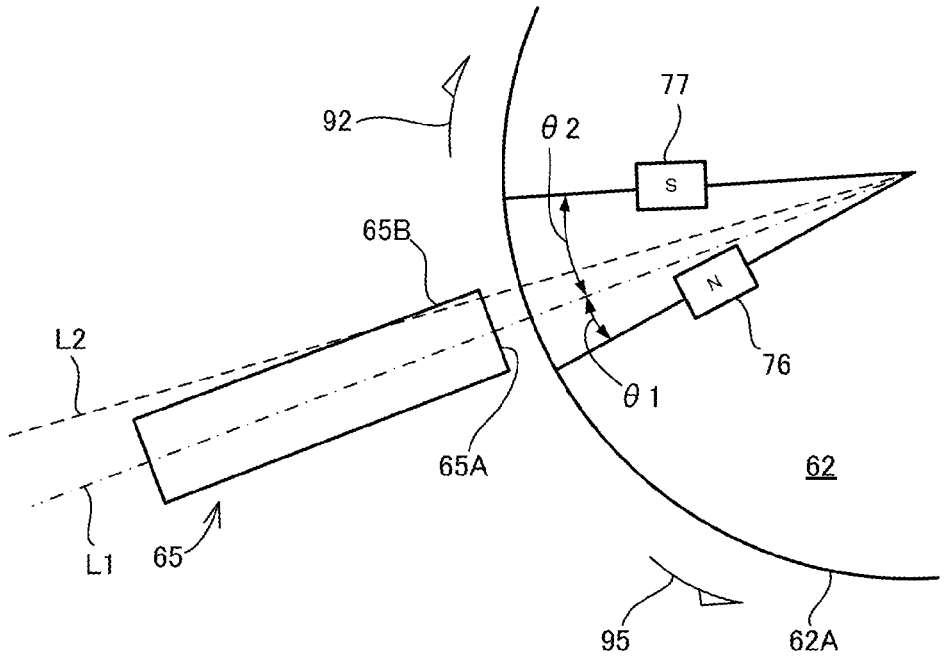
FIG. 3A and FIG. 3B show mounting positions of a regulation pole and a conveyance pole.
Figure 3B:
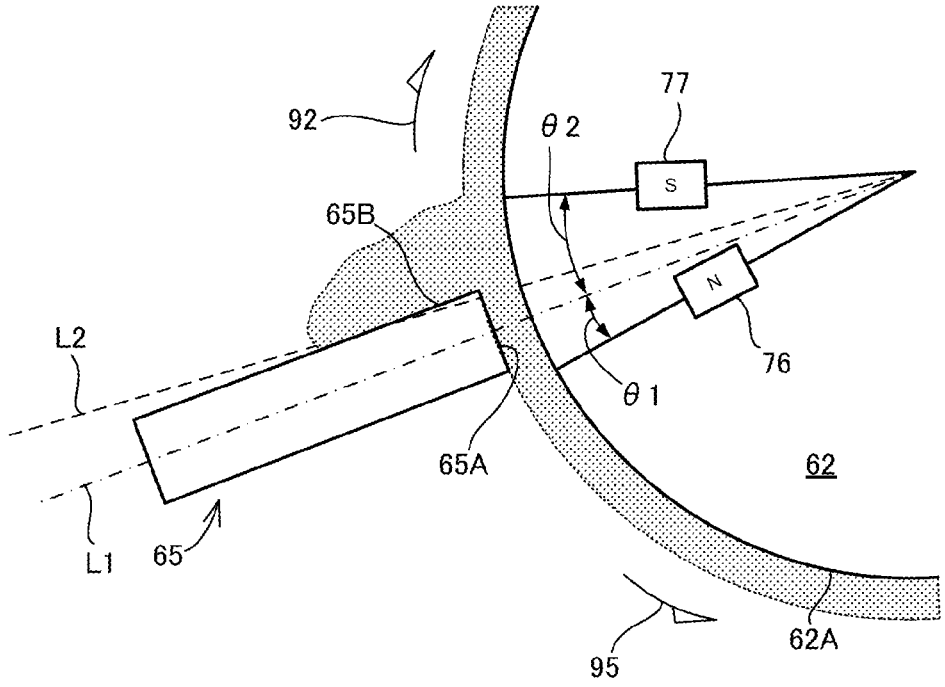

Next, with reference to FIG. 2, FIG. 3A, and FIG. 3B, the developing device 34 will be described in detail. The developing device 34 develops an electrostatic latent image on the photosensitive drum 31 by use of a so-called two-component developer (hereinafter, simply referred to as "developer") whose main components are toner and magnetic carrier. As shown in FIG. 2, the developing device 34 includes a developer container 60 containing a developer. The developer container 60 contains the developer and also serves as a housing for the developing device 34. The developer container 60 is formed in an elongated shape extending along the longitudinal direction (the front-rear direction 8) of the developing device 34. The developer container 60 is sectioned into two storage chambers, i.e. a first storage chamber 60B and a second storage chamber 60C, by a partition wall 60A (one example of a partition member). The first storage chamber 60B and the second storage chamber 60C each contain the developer including the toner. The first storage chamber 60B and the second storage chamber 60C are not completely partitioned from each other, and are provided with, at both ends thereof in the front-rear direction 8, communication paths (not shown) which communicate both chambers.

In the first storage chamber 60B, the first agitating screw 61A is rotatably provided. In the second storage chamber 60C, the second agitating screw 61B is rotatably provided. Each of the first agitating screw 61A and the second agitating screw 61B rotates by receiving rotational driving force transmitted from a stepping motor (not shown) via a transmission mechanism such as gears. In the present embodiment, the first agitating screw 61A and the second agitating screw 61B rotate in determined rotation directions (the directions of the arrows 93 and 94 in FIG. 2) by means of the transmission mechanism, at the time of development. Accordingly, the developer including the toner and the magnetic carrier replenished (supplied) from the toner container 39 (see FIG. 1) through a replenishment port 60D is conveyed in the axial direction while being agitated. Moreover, by the developer being agitated by the first agitating screw 61A and the second agitating screw 61B, the toner is charged with electric charge necessary for development. In the present embodiment, the developer is conveyed to circulate between the first storage chamber 60B and the second storage chamber 60C via the communication paths formed in the partition wall 60A.

The magnetic roller 62 and the developing roller 63 are provided inside the developer container 60. The magnetic roller 62 holds the developer including the toner and the magnetic carrier on the surface thereof. The developing roller 63 and the magnetic roller 62 are provided above the second storage chamber 60C. Specifically, the magnetic roller 62 is arranged above the second agitating screw 61B of the second storage chamber 60C. The developing roller 63 is arranged so as to oppose the magnetic roller 62, diagonally left above the magnetic roller 62. That is, the magnetic roller 62 is arranged below the developing roller 63. The magnetic roller 62 and the developing roller 63 are provided such that their respective surfaces are opposed to each other with a predetermined gap therebetween at the opposing position.

The developing roller 63 opposes the photosensitive drum 31 on an opening side (left in FIG. 2) of the developer container 60. That is, the developing roller 63 is arranged so as to oppose the outer peripheral surface of the photosensitive drum 31. In the present embodiment, the developing roller 63 is provided so as to oppose an area near the center in the vertical direction of the surface of the photosensitive drum 31. The magnetic roller 62 and the developing roller 63 receive, at the time of development, rotational driving force transmitted from the stepping motor (not shown) to be rotated in a rotation direction (hereinafter, referred to as "development rotation direction") indicated by the arrows 91 and 92 in FIG. 2.

The magnetic roller 62 is composed of a rotation sleeve 62A which is nonmagnetic, and a magnetic-roller-side magnetic pole 62B having a plurality of magnetic poles. The rotation sleeve 62A is rotatably supported by a frame not shown of the developing device 34. The magnetic-roller-side magnetic pole 62B is housed in the rotation sleeve 62A. That is, the magnetic-roller-side magnetic pole 62B is provided inside the magnetic roller 62. The magnetic-roller-side magnetic pole 62B is fixed to a frame not shown inside the rotation sleeve 62A. In the present embodiment, the magnetic-roller-side magnetic pole 62B includes five magnetic poles, i.e., a main pole 75, a regulation pole 76 (one example of a first magnetic force generation portion), a conveyance pole 77 (one example of a second magnetic force generation portion), a separation pole 78, and a scooping pole 79. Each of the magnetic poles 75 to 79 is formed by, for example, a permanent magnet which generates magnetic force. These magnetic poles 75 to 79 are used for scooping the developer in the second storage chamber 60C to the magnetic roller 62, and used for separating the developer remaining after development, from the magnetic roller 62.

The main pole 75 is mounted to the magnetic-roller-side magnetic pole 62B in a state where the magnetic pole surface of the main pole 75 is turned toward the developing roller 63 side. The main pole 75 forms a magnetic field in a mutually-attracting direction with a developing-roller-side magnetic pole 63B included in the developing roller 63. In the present embodiment, the polarity of the main pole 75 is set to be N-pole.

The separation pole 78 is arranged on the downstream side in the development rotation direction relative to the main pole 75. The polarity of the separation pole 78 is set to be S-pole. The separation pole 78 forms a magnetic-force-free area on the surface of the magnetic roller 62, with the magnetic field of the scooping pole 79 having the same polarity. This magnetic-force-free area is located above the second storage chamber 60C. When the developer remaining after development has reached this area, the developer is separated and falls into the second storage chamber 60C.

The scooping pole 79 is arranged on the downstream side in the development rotation direction relative to the separation pole 78. The polarity of the scooping pole 79 is set to be S-pole. The scooping pole 79 is provided in a state where the magnetic pole thereof is turned toward the second storage chamber 60C. That is, the scooping pole 79 is provided at a position opposed to the second storage chamber 60C. The magnetic roller 62 magnetically scoops the developer from the second storage chamber 60C by the magnetic force of the scooping pole 79, onto the surface of the magnetic roller 62. The scooped developer is held as a magnetic developer layer on the magnetic roller 62, to be conveyed toward a regulation blade 65 in association with rotation of the magnetic roller 62.

The developer container 60 is provided with the regulation blade 65 (one example of a blade member) for regulating the developer. The regulation blade 65 is formed by, for example, a nonmagnetic body or a magnetic body. The regulation blade 65 is arranged so as to oppose the magnetic roller 62. The regulation blade 65 is mounted along the longitudinal direction (the direction perpendicular to the plane of the sheet of FIG. 2) of the magnetic roller 62. The regulation blade 65 is arranged on the upstream side relative to the position where the developing roller 63 and the magnetic roller 62 oppose each other, in the development rotation direction (see the arrow 92) of the magnetic roller 62. Specifically, as shown in FIG. 2, the regulation blade 65 is provided so as to oppose an area near the center in the vertical direction of the surface of the magnetic roller 62. Between an end portion of the regulation blade 65 and the roller surface of the magnetic roller 62, a predetermined gap is formed. The end portion of the regulation blade 65 has an opposing surface 65A which opposes the surface of the magnetic roller 62. The opposing surface 65A is a flat surface that substantially corresponds to the development rotation direction, and is a surface having a predetermined width in the development rotation direction.

The regulation pole 76 is arranged on the downstream side in the development rotation direction relative to the scooping pole 79. The regulation pole 76 is mounted to the magnetic-roller-side magnetic pole 62B in a state where the magnetic pole surface of the regulation pole 76 is turned toward the regulation blade 65 side. In the present embodiment, the polarity of the regulation pole 76 is set to be N-pole. The magnetic pole surface of the regulation pole 76 opposes the inner surface of the rotation sleeve 62A of the magnetic roller 62. Since the regulation pole 76 is turned toward the regulation blade 65 side, a magnetic field in a mutually-attracting direction is generated in the gap between the end portion of the regulation blade 65 and the rotation sleeve 62A. This magnetic field provides magnetic force to the developer layer on the magnetic roller 62 in the gap. Accordingly, magnetic force is further provided to the developer layer existing in the gap between the regulation blade 65 and the rotation sleeve 62A. The regulation pole 76 is not arranged so as to oppose the opposing surface 65A of the end portion of the regulation blade 65, and is arranged at a position shifted to the side of a rotation direction (hereinafter, referred to as "reverse rotation direction") reverse to the development rotation direction by a predetermined angle from the regulation blade 65. The mounting position of the regulation pole 76 will be described later.

Between the regulation blade 65 and the regulation pole 76, a magnetic path is formed. That is, in the gap between the opposing surface 65A of the regulation blade 65 and the surface of the magnetic roller 62, the magnetic path is formed. When the developer layer attached to the magnetic roller 62 by the scooping pole 79 is conveyed to the gap in association with rotation of the magnetic roller 62, the thickness of the developer layer is regulated in the gap by the regulation blade 65. Accordingly, on the surface of the magnetic roller 62, a uniform developer layer having a predetermined thickness is formed.

The conveyance pole 77 is arranged on the downstream side in the development rotation direction relative to the regulation pole 76, and on the upstream side in the development rotation direction relative to the main pole 75. The polarity of the conveyance pole 77 is a polarity different from the polarity of the regulation pole 76, and specifically, is set to be S-pole. The conveyance pole 77 conveys the developer layer held on the magnetic roller 62 with the magnetic force of the main pole 75, to a position opposed to the developing roller 63. The mounting position of the conveyance pole 77 will be described later.

The developing roller 63 is composed of a developing sleeve 63A having a cylindrical shape and the developing-roller-side magnetic pole 63B. The developing sleeve 63A is rotatably supported by a frame not shown of the developing device 34. The developing-roller-side magnetic pole 63B is housed in the developing sleeve 63A. That is, the developing-roller-side magnetic pole 63B is provided inside the developing roller 63. The developing-roller-side magnetic pole 63B is formed by, for example, a permanent magnet which generates magnetic force. In order to form a magnetic field in a mutually-attracting direction with the main pole 75 of the magnetic roller 62, the polarity of the developing-roller-side magnetic pole 63B is set to be a polarity (S-pole) different from that of the main pole 75.

To the developing roller 63, a predetermined bias voltage is applied. Moreover, also to the magnetic roller 62, a predetermined potential is applied. By the potential difference between the potential applied to the magnetic roller 62 and the bias voltage applied to the developing roller 63, and by the magnetic fields by the main pole 75 and the like, developer in a brush shape (magnetic brush) and extending toward the developing roller 63 is formed in the magnetic roller 62 at a position opposed to the developing roller 63. By this magnetic brush, the toner is carried to the surface of the developing roller 63, whereby a thin toner layer is formed on the surface of the developing roller 63.

The thin toner layer formed on the developing roller 63 by the magnetic brush is conveyed to a portion where the photosensitive drum 31 and the developing roller 63 are opposed to each other, as a result of rotation of the developing roller 63. Since a voltage is being applied to the developing roller 63, toner flies due to the potential difference between the developing roller 63 and the photosensitive drum 31, whereby the electrostatic latent image on the photosensitive drum 31 is developed.

When the rotation sleeve 62A of the magnetic roller 62 further rotates in the clockwise direction, then, by a magnetic field in the horizontal direction (roller circumferential direction) generated by the conveyance pole 77 having a different polarity and being adjacent to the main pole 75, the magnetic brush is separated from the surface of the developing roller 63, and the toner that has not been used in the development and has remained is collected from the developing roller 63 onto the rotation sleeve 62A. When the rotation sleeve 62A further rotates, since the separation pole 78 of the magnetic-roller-side magnetic pole 62B and the scooping pole 79 having the same polarity as the separation pole 78 provide a repelling magnetic field, the developer falls off from the rotation sleeve 62A in the developer container 60 to be stored in the second storage chamber 60C. Then, the developer is agitated and conveyed by the second agitating screw 61B. Then, as the two-component developer having a proper toner density and being uniformly charged, the developer is again held on the rotation sleeve 62A by the scooping pole 79, and then, forms a developer layer, to be conveyed to the regulation blade 65.

In the developing device 34, when the toner flies from the developing roller 63 to be transferred to the photosensitive drum 31, when the toner is transferred from the magnetic roller 62 to the developing roller 63, or when the developer layer is regulated by the regulation blade 65, a part of the toner scatters inside the developing device 34. There are cases where the scattered toner attaches to accumulate on a surface 65B on the developing roller 63 side of the regulation blade 65. If the uncollected toner accumulated on the surface 65B of the regulation blade 65 comes off and moves to the developing sleeve 63A and the photosensitive drum 31, the toner layer on the developing roller 63 is disturbed or the amount of toner held on the developing roller 63 varies. Moreover, an excessive amount of toner may be supplied to the photosensitive drum 31. This may cause a risk of lowered quality of the image to be formed, resulting in poor image. It should be noted that a typical developing device may be provided with, separate from the mechanism to rotate the rotation sleeve 62A of the magnetic roller 62, a mechanism to rotate the magnetic-roller-side magnetic pole 62B inside the magnetic roller 62. In this typical example, however, there is a problem that not only the configuration becomes complicated but also the number of parts is increased, resulting in increased costs.

The developing device 34 of the present embodiment is configured to be able to prevent occurrence of poor image due to uncollected toner, by assuredly collecting toner attached and accumulated on the regulation blade 65 by use of a simple structure. Specifically, in the developing device 34, during non-development time when a developing process is not performed, the stepping motor (not shown) is controlled to be driven in the reverse direction by the control portion 5. Accordingly, the rotation sleeve 62A of the magnetic roller 62 is rotated in a rotation direction reverse to the development rotation direction (the direction of the arrow 92 in FIG. 2). By this rotation in the reverse direction, a developer pile is caused to occur on the surface 65B of the regulation blade 65, uncollected toner is caused to be attached to this developer pile, and the uncollected toner is collected together with the developer pile.

In the course of collecting the uncollected toner as above, making a larger developer pile on the surface 65B of the regulation blade 65 leads to collection of more uncollected toner. In the present embodiment, by positioning the regulation pole 76 and the conveyance pole 77 at positions described below, more developer is piled on the surface 65B of the regulation blade 65.

Hereinafter, mounting positions of the regulation pole 76 and the conveyance pole 77 will be described with reference to FIG. 3A and FIG. 3B. FIG. 3A and FIG. 3B are schematic diagrams showing mounting positions of the regulation pole 76 and the conveyance pole 77. In FIG. 3A and FIG. 3B, a straight line L2 indicated by a broken line is a line segment perpendicular to the surface of the rotation sleeve 62A and passing a point where, among magnetic fields formed by the regulation pole 76 and the conveyance pole 77, a magnetic field (one example of a tangent direction magnetic field) having only a component in the tangent direction at the surface of the rotation sleeve 62A of the magnetic roller 62 is generated. A straight line L1 (one example of a reference line) indicated by a one-dot chain line is a line segment passing the center of the opposing surface 65A of the regulation blade 65 and perpendicular to the opposing surface 65A. In the present embodiment, as shown in FIG. 3A and FIG. 3B, inside the magnetic roller 62, the regulation pole 76 is provided at a position separated from the straight line L1 by an angle θ1 to the upstream side in the development rotation direction (the direction of the arrow 92). The conveyance pole 77 is provided at a position separated from the straight line L1 by an angle θ2 to the downstream side in the development rotation direction (the direction of the arrow 92). Further, the regulation pole 76 and the conveyance pole 77 are positioned inside the magnetic roller 62 such that, among the magnetic fields formed by the regulation pole 76 and the conveyance pole 77, a magnetic field (tangent direction magnetic field) having only a component in the tangent direction at the surface of the rotation sleeve 62A of the magnetic roller 62 is generated in the gap between the opposing surface 65A and the rotation sleeve 62A. In other words, as shown in FIG. 3A and FIG. 3B, the regulation pole 76 and the conveyance pole 77 are arranged such that the straight line L2 passes the gap.

In particular, in the present embodiment, the regulation pole 76 and the conveyance pole 77 are positioned such that the tangent direction magnetic field is generated on the downstream side in the development rotation direction (the direction of the arrow 92) relative to the straight line L1. In other words, the first magnetic force generation portion and the second magnetic force generation portion are arranged such that the straight line L2 passes, in the gap, on the downstream side in the development rotation direction relative to the straight line L1. In this case, the developer layer present in the gap does not receive magnetic force in a direction perpendicular to the surface of the rotation sleeve 62A. Thus, in the gap, the force for holding the developer is reduced, and as a result, the developer layer becomes able to easily accumulate in the gap.

In a state where the regulation pole 76 and the conveyance pole 77 are arranged in this manner, when the rotation sleeve 62A of the magnetic roller 62 is rotated in a direction (the direction of an arrow 95) reverse to the development rotation direction by the control portion 5 during non-development time as described above, the developer accumulates in the gap to spill over the gap. As a result, as shown in FIG. 3B, a larger developer pile is caused on the surface 65B of the regulation blade 65. Thereafter, by the rotation sleeve 62A being further rotated in the direction of the arrow 95 or in the development rotation direction, the developer pile is collected, and at this time, the toner having been attached to the surface 65B of the regulation blade 65 is also assuredly collected together with the developer pile.

EXAMPLE 1

Hereinafter, Example 1 of the present disclosure will be described. As Example 1, the developing device 34 was manufactured that included the magnetic roller 62 having an outer diameter of 16 mm, the developing roller 63 having an outer diameter of 16 mm, a developer including toner having a particle size of 7 μm and magnetic carrier having a particle size of 50 μm, the regulation pole 76 having a magnetic flux density of 45 mT, and the conveyance pole 77 having a magnetic flux density of 60 mT. In the developing device 34, the rotation speed in the development rotation direction of the magnetic roller 62 was 314 $min^{-1}$, and the rotation speed in the reverse direction was 157 $min^{-1}$. The gap between the regulation blade 65 and the rotation sleeve 62A was 0.30 mm. In this developing device 34, the θ1 was 8° and the θ2 was 12°. That is, the regulation pole 76 was provided such that the center of the magnetic pole was aligned with a position separated from the straight line L1 by an angle of 8° to the upstream side in the development rotation direction (the direction of the arrow 92). Moreover, the conveyance pole 77 was provided such that the center of the magnetic pole was aligned with a position separated from the straight line L1 by an angle of 12° to the downstream side in the development rotation direction (the direction of the arrow 92). FIG. 3A shows the general positional relationship between the regulation pole 76 and the conveyance pole 77 of Example 1. In Example 1, as shown in FIG. 3A and FIG. 3B, the straight line L2 passes, in the gap, a position on the most downstream side in the development rotation direction, that is, passes an end portion on the downstream side in the opposing surface 65A.

In Comparative Example 1 and Comparative Example 2 described later, even when the magnetic roller 62 was rotated in the reverse direction, no developer pile occurred on the regulation blade 65 at all. However, in Example 1, when the magnetic roller 62 was rotated in the reverse direction, developer accumulation occurred in a downstream end portion of the gap where no perpendicular magnetic field existed, and a large developer pile (a pile having a thickness of 1.0 mm or greater) occurred on the surface 65B of the regulation blade 65. Further, in the developing device 34 of Example 1, stability of the conveyance amount of the developer during development was evaluated. As an evaluation method, the difference between the conveyance amount in a low-temperature and low-humidity environment (in the present Example, the external temperature was 10° C., and the external humidity was 15%), and the conveyance amount in a high-temperature and high-humidity environment (in the present Example, the external temperature was 32.5° C., and the external humidity was 80%) was used as an index. In the developing device 34 of Example 1, the conveyance amount difference was less than 10 $mg/cm^2$, and very high conveyance amount stability was obtained. In Comparative Example 1 described later, the conveyance amount stability was very bad, and the conveyance amount difference was not less than 15 $mg/cm^2$. In Comparative Example 2 described later, the developer did not accumulate during reverse rotation, but the conveyance amount difference was less than 10 $mg/cm^2$, and very high conveyance amount stability was obtained.

In Comparative Example 1, the θ1 was 23° and the θ2 was 15°, in contrast to the configuration of in Example 1. In Comparative Example 2, the θ1 was 8° and the θ2 was 28°, in contrast to the configuration of Example 1.

EXAMPLE 2

Figure 4A:
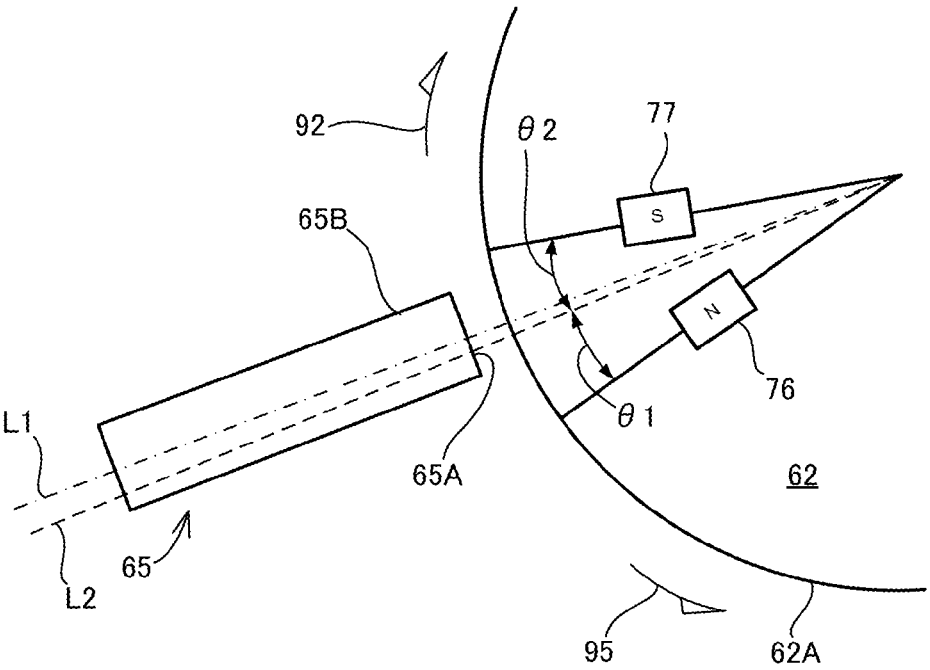
FIG. 4A and FIG. 4B show other examples of mounting positions of the regulation pole and the conveyance pole.

Hereinafter, Example 2 of the present disclosure will be described. In Example 2, the θ1 was 12° and the θ2 was 8°, in contrast to the configuration of Example 1. FIG. 4A shows a general positional relationship between the regulation pole 76 and the conveyance pole 77 of Example 2. In Example 2, as shown in FIG. 4A, the straight line L2 passes, in the gap, a position on the upstream side in the development rotation direction, that is, passes an area on the upstream side in the opposing surface 65A. In Example 2, when the magnetic roller 62 is rotated in the reverse direction, a developer pile (a pile having a thickness of not less than 0 mm and less than 1.0 mm) occurred on the surface 65B of the regulation blade 65. Moreover, in the developing device 34 of Example 2, the conveyance amount difference was less than 10 $mg/cm^2$, and very high conveyance amount stability was obtained. Since the straight line L2 passed, in the gap, a position on the upstream side in the development rotation direction, and developer accumulation occurred at this position, the amount of the developer spilling over onto the surface 65B of the regulation blade 65 was slightly less than that in Example 1. However, since the regulation pole 76 and the conveyance pole 77 were relatively close to each other, high conveyance amount stability was obtained.

EXAMPLE 3

Figure 4B:
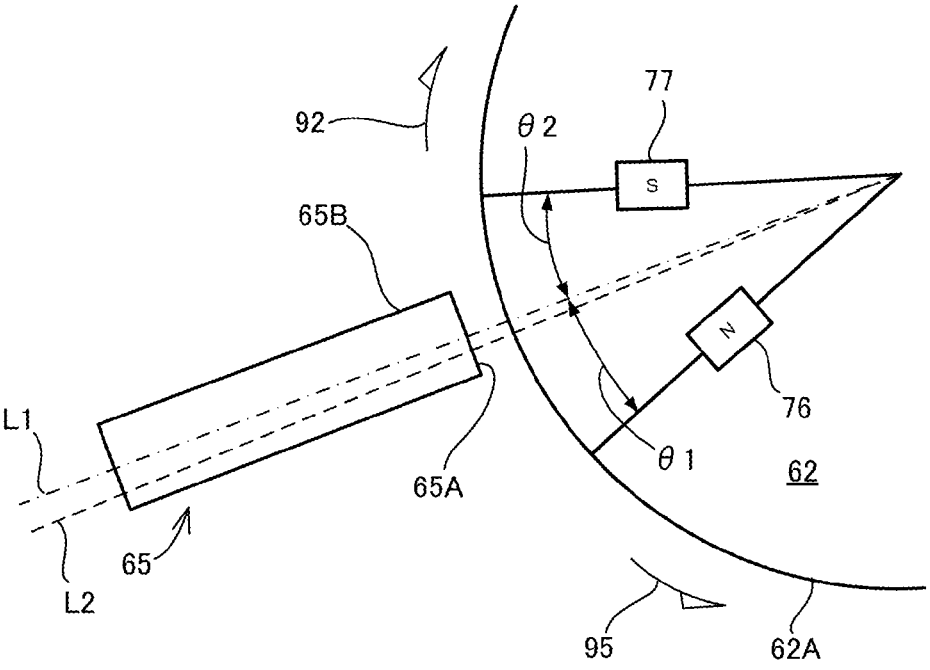

Hereinafter, Example 3 of the present disclosure will be described. In Example 3, the θ1 was 20°, and the θ2 was 16°, in contrast to the configuration of Example 1. FIG. 4B shows a general positional relationship between the regulation pole 76 and the conveyance pole 77 of Example 3. In Example 3, as shown in FIG. 4B, the straight line L2 passes, in the gap, a position on the upstream side in the development rotation direction, that is, passes an area on the upstream side in the opposing surface 65A. In Example 3, when the magnetic roller 62 was rotated in the reverse direction, a developer pile (a pile having a thickness of not less than 0 mm and less than 1.0 mm) occurred on the surface 65B of the regulation blade 65. Moreover, in the developing device 34 of Example 3, the conveyance amount difference was not less than 10 mg/cm$^2$ and less than 15 mg/cm$^2$, and high conveyance amount stability was obtained. Since the straight line L2 passed, in the gap, a position on the upstream side in the development rotation direction and developer accumulation occurred at this position, the amount of the developer spilling over onto the surface 65B of the regulation blade 65 was slightly less than that in Example 1. However, since the regulation pole 76 and the conveyance pole 77 were relatively distanced from each other, the conveyance amount stability was slightly inferior to that in Example 1 and Example 2.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing device comprising:

a magnetic roller configured to hold, on a surface thereof, a developer including toner and magnetic carrier;

a developing roller arranged so as to oppose the magnetic roller;

a blade member provided so as to oppose an area near a center in a vertical direction of the surface of the magnetic roller on an upstream side relative to the developing roller in a forward rotation direction of the magnetic roller to be rotated during development, the blade member including an opposing surface having a predetermined width in the forward rotation direction;

a first magnetic force generation portion provided, inside the magnetic roller, on an upstream side in the forward rotation direction relative to a reference line, the reference line passing a center of the opposing surface of the blade member and perpendicular to the opposing surface, the first magnetic force generation portion configured to provide magnetic force of a predetermined first polarity to the developer held on the magnetic roller; and a second magnetic force generation portion provided, inside the magnetic roller, on a downstream side in the forward rotation direction relative to the reference line, the second magnetic force generation portion configured to provide magnetic force of a second polarity opposite to the first polarity to the developer held on the magnetic roller;

a rotation control portion configured to rotate the magnetic roller in a reverse rotation direction opposite to the forward rotation during non-development time, and then further rotate the magnetic roller in the reverse rotation direction or in the forward rotation direction, wherein the first magnetic force generation portion and the second magnetic force generation portion are positioned such that, among magnetic fields formed by the first magnetic force generation portion and the second magnetic force generation portion, a tangent direction magnetic field having only a component in a tangent direction at the surface of the magnetic roller is generated in a gap between the surface of the magnetic roller and the opposing surface, and such that the tangent direction magnetic field is generated on the downstream side in the forward rotation direction relative to the reference line.

2. An image forming apparatus including the developing device according to claim 1.

* * * * *